US010472778B2

(12) United States Patent
Schmidt et al.

(10) Patent No.: US 10,472,778 B2
(45) Date of Patent: Nov. 12, 2019

(54) ROAD FINISHER WITH PIVOTING MATERIAL DEFLECTOR

(71) Applicant: JOSEPH VOEGELE AG, Ludwigshafen/Rhein (DE)

(72) Inventors: Thomas Schmidt, Plankstadt (DE); Martin Seibel, Bruchsal (DE); Philipp Stumpf, Heidelberg (DE)

(73) Assignee: JOSEPH VOEGELE AG, Ludwigshafen/Rhein (DE)

( * ) Notice: Subject to any disclaimer, the term of this patent is extended or adjusted under 35 U.S.C. 154(b) by 0 days.

(21) Appl. No.: 16/217,155

(22) Filed: Dec. 12, 2018

(65) Prior Publication Data

US 2019/0177927 A1 Jun. 13, 2019

(30) Foreign Application Priority Data

Dec. 13, 2017 (EP) ..... 17206966

(51) Int. Cl.
*E01C 19/48* (2006.01)

(52) U.S. Cl.
CPC ..... *E01C 19/4873* (2013.01); *E01C 19/48* (2013.01); *E01C 2301/00* (2013.01)

(58) Field of Classification Search
CPC ... E01C 19/4873; E01C 19/48; E01C 2301/00
USPC ..... 404/101–105, 118
See application file for complete search history.

(56) References Cited

U.S. PATENT DOCUMENTS

| | | | | |
|---|---|---|---|---|
| 3,901,616 | A | 8/1975 | Greening | |
| 4,801,218 | A | 1/1989 | Musil | |
| 8,870,101 | B2 * | 10/2014 | Gibson | E01C 19/2025 239/674 |

FOREIGN PATENT DOCUMENTS

| | | | |
|---|---|---|---|
| DE | 2 140 058 | A1 | 2/1973 |
| DE | 299 07 733 | U1 | 9/1999 |
| EP | 0 849 398 | A1 | 6/1998 |
| EP | 0849398 | B1 | 9/2003 |
| GB | 1 355 620 | A | 6/1974 |
| JP | H08-218315 | A | 8/1996 |
| JP | 2004-108042 | A | 4/2004 |
| WO | 92/20865 | A1 | 11/1992 |

OTHER PUBLICATIONS

European Search Report dated Jun. 20, 2018, Application No. EP 17 20 6966, 8 Pages.
Bomag Fayat Group, CR600 Series Pavers & MTV, www.bomag.com/us, CR600MTV2015 Feb. 20, 2015, 16 Pages.

* cited by examiner

*Primary Examiner* — Raymond W Addie
(74) *Attorney, Agent, or Firm* — Brooks Kushman P.C.

(57) ABSTRACT

A road finisher includes a lifting device which is designed to lift the chassis relative to the undercarriage at least in a rear region of the road finisher. The road finisher further comprises a material deflector, which can be pivoted relative to the chassis, and that is arranged between the two traction tracks.

18 Claims, 9 Drawing Sheets

ROAD FINISHER WITH PIVOTING MATERIAL DEFLECTOR

CROSS-REFERENCE TO RELATED APPLICATIONS

This application claims foreign priority benefits under 35 U.S.C. § 119(a)-(d) to European patent application number EP 17206966.8, filed Dec. 13, 2017, which is incorporated by reference in its entirety.

TECHNICAL FIELD

The present disclosure relates to road finishers with a chassis that can be lifted in relation to the undercarriage at least in a rear region of the road finisher.

BACKGROUND

Known road finishers include a hopper at the front of the road finisher with respect to the paving direction to accommodate paving material. During paving, the paving material is conveyed from the hopper to the rear of the road finisher via a suitable longitudinal conveyor. There, a spreading auger distributes the paving material transverse to the paving direction, thus feeding it evenly to a paving screed pulled behind by the road finisher for compacting the paving material.

It is known from DE 2 140 058 A1, for example, to provides shielding plates in the area of the spreading auger, which support the spreading of the paving material. It is known from GB 1 355 620 A to provide a joint in such shielding plates so that part of the plate can swerve in a folding movement when it collides with objects.

It is known from practice to attach the spreading auger to the road finisher chassis in a height-adjustable manner. By adjusting the height of the spreading auger relative to the chassis, the road finisher can be adapted for paving different layer thicknesses. For example, the spreading auger can be lifted relative to the chassis to pave thicker layers.

A disadvantage of such a system is that for paving very thick layers the position of the auger relative to the chassis is significantly changed upwards. This can lead to a situation where the spreading auger at least partially blocks a material outlet of the longitudinal conveyor. This reduces the throughput of paving material to the paving screed, which is particularly disadvantageous with large layer thicknesses, as these require an increased quantity of paving material.

From EP 0 849 398 A1, a road finisher is known whose rear section can be lifted for paving thick layers. This is achieved by providing a vertical guidance, which can be adjusted in height by a hydraulic positioning cylinder, between a crawler undercarriage and a chassis of the road finisher. At the front, the chassis is rotatably mounted on the crawler undercarriage. A disadvantage of this system is the high loads on the hydraulic positioning cylinders, which essentially carry the weight of the lifted chassis completely. Correspondingly, high forces are required for height adjustment. Therefore, stability of the road finisher also suffers.

Other road finishers with a chassis that can be lifted at least in a rear area are known from U.S. Pat. Nos. 4,801,218 A and 3,901,616 A. Also, here high forces act on hydraulic positioning cylinders, which carry the weight of the chassis essentially completely.

From the brochure "CR600 SERIES PAVERS & MTV" from BOMAG, a further system for lifting the chassis in relation to the undercarriage in the rear area of a road finisher is known under the designation "Frame Raise System". In this system, a large circular disc is arranged vertically at the chassis in the paving direction of the road finisher. The disc is rotatably mounted at the chassis along its circumference. The disc can thus be rotated around a main axis of rotation running through its center and transverse to the direction of the road finisher. Eccentrically to the main axis of rotation, a connection to the road finisher's undercarriage is provided on an outer surface of the disc which can be rotated about a side axis transverse to the paving direction. The disc can be rotated in its support at the chassis by a hydraulic cylinder. When the disc is rotated, the eccentricity of the connection between the disc and the undercarriage changes the mutual height relationship between the chassis and the undercarriage at the rear of the road finisher. Although the weight of the chassis no longer has to be borne entirely by the hydraulic cylinder, this system still has to apply high forces to rotate the disc when lifting the chassis. Also, when holding the chassis in a certain height position, high loads are applied to the hydraulic cylinder.

Lifting the chassis increases the distance between the chassis and the ground, creating a space where the paving material can penetrate. This can increase the time it takes for the paving material located under the chassis to cool before it is compacted by the paving screed. In addition, segregation can occur. Both can lead to a deterioration in the quality of the asphalt pavement laid.

SUMMARY

It is an object of the disclosure to improve road finishers with a chassis that can be lifted at the rear region in such a way that the quality of the asphalt layer paved is increased using the simplest possible constructive measures.

The road finisher according to the disclosure comprises an undercarriage with two traction tracks and a chassis. It also includes a hopper for receiving paving material mounted at the chassis at the front of the road finisher with respect to a paving direction and a paving screed for compacting paving material provided at the rear of the road finisher with respect to the paving direction, which is attached to the chassis by pulling arms. It also includes a lifting device adapted to lift the chassis in relation to the undercarriage at least in a rear region of the road finisher. The road finisher according to the disclosure is characterized in that a material deflector, which can be moved, in particular pivoted, relative to the chassis, is provided between the two traction tracks.

As an alternative to a pivoting version, a sliding material deflector is also conceivable. Such a deflector can be designed as a sliding plate. A sliding plate may, for example, be slidably mounted in a recess on or in the chassis and moved out of it to extend the material deflector. It should be clear to the person skilled in the art that pivoting material deflectors on the one hand and extendable material deflectors on the other hand can have different advantages and technical effects. In the following, the terms "folded out/folded in" and "extended/retracted" as well as "extend/retract" and "fold out/fold in" are used synonymously, although the variants are not obvious equivalents.

Traction tracks can be defined as areas which extend substantially in the driving direction and in which the traction elements of the road finisher's undercarriage are in contact with the ground in order to provide for traction and directional stability of the road finisher. The undercarriage may be designed as a crawler or wheeled undercarriage and carry the chassis. The arrangement of the material deflector between the traction tracks may prevent paving material from penetrating into the space between the traction tracks or between the chassis and the ground, respectively. The movable design of the material deflector may ensure on one hand that its arrangement can be adapted to different lifting heights of the chassis. On the other hand, when not in use, e.g., when the chassis is completely lowered, the material deflector can be carried along by the road finisher in a folded position. Therefore, there may not be a need for a disassembly after lowering or for an assembly during or before lifting.

It is advantageous if an actuator unit is provided which is configured to move the material deflector relative to the chassis, in particular to pivot it.

Also conceivable is a sensor unit which is configured to detect a distance of the chassis from a ground and/or a lifting movement between the chassis and the undercarriage and/or the distance of a lower edge of the material deflector to the ground. This allows monitoring or open loop or closed loop control of the lifting process and/or the pivoting process of the material deflector.

It is particularly advantageous if the actuator unit is configured to move, in particular pivot, the material deflector based on signals generated by the sensor unit. In this way, the (pivoting) position of the material deflector can be adapted to one or more of the above parameters that can be detected by the sensor unit. It is conceivable, for example, that the distance between the lower edge of the material deflector and the ground is continuously detected and can be kept constant by controlling the (pivoting) position of the material deflector even when the chassis is raised.

It is particularly advantageous if the distance between the ground and a lower edge of the material deflector is always equal to or greater than the minimum ground clearance of the road finisher.

The actuator unit can comprise an electric, hydraulic, electrohydraulic or pneumatic actuator in various variants.

In other variants, the sensor unit can have a laser sensor, a radar sensor or an ultrasonic sensor.

It is advantageous if the lifting device comprises a rocker which is supported rotatably around an undercarriage rotation axis at an undercarriage-side bearing surface, and is supported rotatably around a chassis rotation axis at a chassis-side bearing surface. The undercarriage-side bearing surface may be a bearing surface which is part of the undercarriage or at least fixed to the undercarriage. The chassis-side bearing surface may be a bearing surface which is part of the chassis or at least fixed to the chassis.

Preferably, the undercarriage rotation axis and the chassis rotation axis are parallel to each other and, in particular, each run in a horizontal plane and perpendicular to the paving direction, i.e., in a transverse direction of the road finisher. In particular, the undercarriage rotation axis and the chassis rotation axis are not identical. Preferably, the undercarriage rotation axis and the chassis rotation axis are offset parallel to each other.

It is particularly advantageous if the lifting device also comprises a length-variable adjustment element, which connects a chassis-side link point with a rocker-side link point and is configured to change a distance between the chassis-side link point and the rocker-side link point by changing its length and thus selectively lift or lower the chassis relative to the undercarriage. The chassis-side link point can be a link point that is part of the chassis or at least fixed to the chassis. The rocker-side link point may be a link point which is part of the rocker or at least fixed to the rocker.

In particular, the length-variable adjustment element can be hinged to the chassis-side link point and the rocker-side link point. Preferably a first end of the length-variable adjustment element is hinged to the chassis-side link point and a second end of the length-variable adjustment element is hinged to the rocker-side link point. However, it is also conceivable that the length-variable adjustment element may extend beyond the respective link point on one or both sides.

In another variant, the road finisher may include a coupling mechanism configured to pivot the material deflector relative to the chassis when the lifting device lifts the chassis relative to the undercarriage. The pivoting position of the material deflector may be automatically adjusted to the height of the chassis by such a coupling mechanism.

In an advantageous variant, the coupling mechanism can have a deflection lever that is rotatably attached to the chassis.

It is conceivable that the coupling mechanism may include an open loop or closed loop control unit connected to the sensor unit and the actuator unit, the control unit actuating the actuator unit in response to signals received from the sensor unit.

It is also conceivable that an undercarriage protector is provided which is arranged behind one of the traction tracks in the paving direction. This may prevent paving material from reaching the traction elements of the road finisher and negatively influencing their traction properties, for example. In addition, disadvantages such as those described above with regard to paving material passing under the chassis can be avoided.

It is conceivable that the undercarriage protector in a position of the chassis that is lowered to a maximum relative to the undercarriage is covered by the latter towards the rear of the road finisher and may be exposed by lifting the chassis. Such a configuration may have the advantage that no additional mechanism is required to bring the undercarriage protector into the desired position. Rather, the undercarriage protector can be placed in a suitable position and may be used only when the chassis is raised.

In another variant, the actuator unit and/or the coupling mechanism can have an elastic element. Such an elastic element may prevent damage to the actuator unit or the coupling mechanism, for example if the material deflector is blocked by objects during pivoting and/or comes into contact with objects while the road finisher is moving and/or driving. The elastic element may be pre-stressed.

It is particularly advantageous if the elastic element is configured to be deflected when the movement and/or pivoting of the material deflector is blocked. Depending on the design of the elastic element, a deflection can be defined as a change in length or, in general, a change in dimensions, torsion or reversible deformation.

In the following, the distance between two axes or between an axis and a bearing surface can be defined as the respective minimum distance.

In a variant, a distance between the chassis rotation axis and the undercarriage rotation axis is greater than a distance between the chassis rotation axis and the chassis-side bearing surface. This can mean that the undercarriage rotation axis is outside the rocker bearing on the chassis. This can result in improved power transmission when lifting or holding the chassis. In addition, the lifting device can be designed to be compact.

Preferably, the length-variable adjustment element is configured to change the position of the rocker relative to the undercarriage or chassis by changing its length. This means that the position of the rocker can be used to provide clearly defined operating states, which can be set as discrete settings, for example, especially if the lifting device allows the height of the chassis to be continuously adjusted in relation to the undercarriage.

Preferably, the ratio of the absolute value of the part of the connection vector between the rocker-side link point and the undercarriage rotation axis perpendicular to the longitudinal extension direction of the length-variable adjustment element to the absolute value of the part of the connection vector between the undercarriage rotation axis and the chassis rotation axis extending in a horizontal direction is greater than 0.5, 0.7, 1, 1.3, 1.5 or 2. Due to a leverage effect, a particularly good power transmission is achieved when lifting or holding the chassis by the length-variable adjustment element. In particular, the ratio described can exceed one of the specified limits over the entire adjustment range of the chassis height. However, it can also be sufficient if this is the case in a maximum lowered or a maximum lifted state of the chassis or at least in an intermediate lifted state of the chassis.

The length-variable adjustment element preferably extends at least substantially along a horizontal direction. Thus, the weight of the chassis acting at least essentially along a vertical direction is at least partially taken up by the rocker or the chassis-side and undercarriage-side bearing surfaces and does not have to be completely borne by the length-variable adjustment element. This contributes to the stability of the entire arrangement. The fact that the length-variable adjustment element extends at least substantially along a horizontal direction may mean that a horizontal component of the direction of extension of the length-variable adjustment element is greater than a vertical component of the direction of extension of the length-variable adjustment element, and/or that an angle of inclination between the length-variable adjustment element and a horizontal plane does not exceed 10°, 15°, 25° or 45°.

Preferably, at least in some operating positions, the chassis-side link point is located in front of or behind the chassis rotation axis and/or the undercarriage rotation axis in relation to the direction of paving. Good power transmission can thus be achieved due to a leverage effect.

A lower abutment may be provided at the chassis, which is configured to secure the chassis against further lowering by engaging the rocker when the chassis is in a maximum lowered state. This relieves the load on the length-variable adjustment element when the chassis is in its maximum lowered state. In addition, the maximum lowered state of the chassis is firmly defined by the abutment. The lower abutment also serves as a safety device in the event of a malfunction of the lifting device.

An upper abutment may be provided at the chassis, which is configured to secure the chassis against further lifting by engaging the rocker when the chassis is in a maximum lifted state. Such an upper abutment serves as a safety device against overturning of the lifting device.

The length-variable adjustment element may be a hydraulic cylinder. A hydraulic cylinder can be easily integrated into a hydraulic system usually provided on a road finisher and allows large forces to be transferred. Alternatively, the length-variable adjustment element could also be a spindle drive. This could provide a purely mechanical solution.

The road finisher may also include an actuator to change the length of the length-variable adjustment element. Such an actuator could be, for example, a hydraulic pump for actuating a hydraulic cylinder or a motor for actuating a spindle drive. In addition, a control element for controlling the actuator can be provided for optionally lifting or lowering the chassis relative to the undercarriage. The control element may allow a driver to adjust the height of the chassis using operating elements.

Preferably, a locking element is provided which is configured to mechanically lock the rocker in a defined relative position with respect to the chassis. In this way, the chassis can be held mechanically at a defined height, thus relieving the load on the length-variable adjustment element. The locking element can be configured to lock the rocker exclusively in a predetermined relative position with respect to the chassis, in particular in a position corresponding to a transport height of the chassis.

The locking element can be a locking bolt provided on the chassis which can be extended for locking engagement with a locking structure such as an opening or recess in the rocker. In particular, the locking element can be extended horizontally, in particular perpendicularly to the paving direction.

The chassis can be pivotally attached to the undercarriage in the front region of the road finisher so that there is no tension between the chassis and the undercarriage when the chassis is lifted asymmetrically along the paving direction.

To avoid tensions, the chassis can be mounted at the undercarriage in a front region of the road finisher such that it can be displaced longitudinally in relation to the direction of paving.

Preferably, the road finisher comprises a spreading auger for distributing paving material in front of the paving screed transversely to the direction of travel. The road finisher can also be equipped with a conveyor device for conveying paving material from the hopper to the spreading auger. The spreading auger can be fixed to the chassis in a fixed position relative to the chassis. Since the chassis can be lifted in relation to the undercarriage as a whole, it is not necessary to adjust the height of the spreading auger in relation to the chassis, thus achieving greater stability. Lifting the chassis with the spreading auger attached to it as a whole does not alter the spatial relationship between the spreading auger and a material outlet of the conveyor device. There is no blocking of the material outlet when the chassis is lifted to achieve high paving thicknesses.

In the following, embodiments according to the disclosure will be explained in more detail with reference to the attached drawings.

BRIEF DESCRIPTION OF THE DRAWINGS

FIG. 6B shows the view from FIG. 6A with the material deflector folded in.

DETAILED DESCRIPTION

Figure 1:
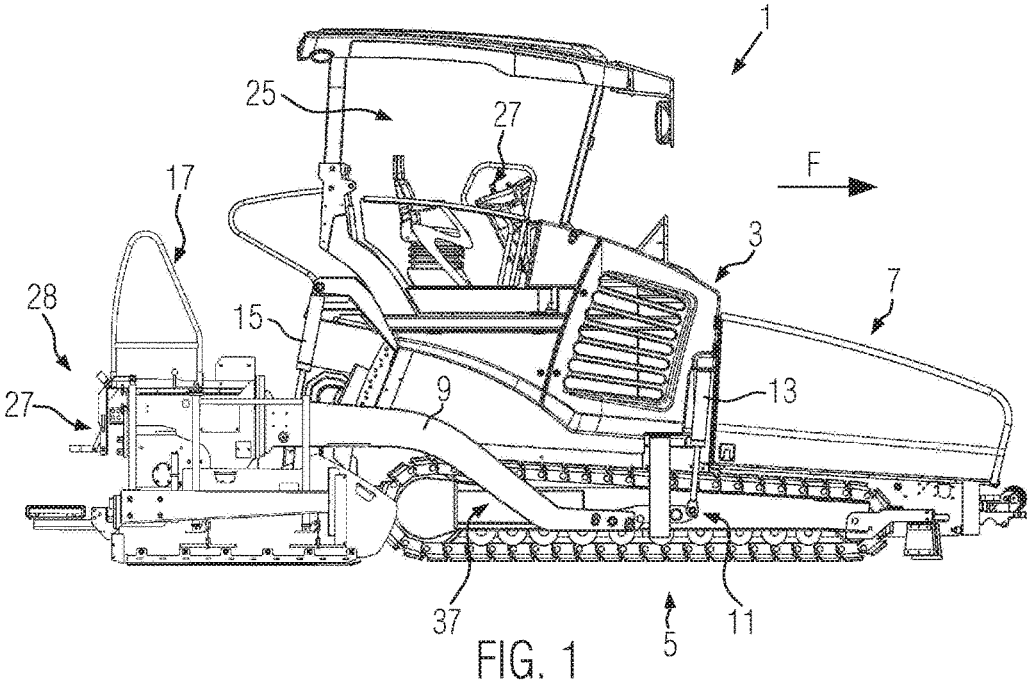
FIG. 1 shows a schematic side view of a road finisher according to an embodiment.

FIG. 1 shows a schematic side view of a road finisher 1 according to the disclosure according to an embodiment. The road finisher 1 comprises a chassis 3 and an undercarriage 5, in this case a crawler track. In paving direction F at the front, a hopper 7 for receiving paving material is fitted at chassis 3. On both lateral sides of road finisher 1, with regard to paving direction F, a pulling arm 9 is mounted on chassis 3 via a height-adjustable link point 11. The link point 11 can be adjusted in height at the road finisher 1 using a linkage hydraulic cylinder 13. At the rear of the road finisher 1, the pulling arms 9 are attached to both sides of the chassis 3 via height-adjustable rear hydraulic cylinders 15. A paving screed 17 for compacting paving material is suspended from the rear end of the pulling arms 9 with respect to paving direction F. During paving, the paving screed 17 is pulled by the pulling arms 9 floating on the paving material behind the road finisher 1. In the rear region of the road finisher 1, the paving material leaves conveyor device 19 through a material outlet 21 and reaches a spreading auger 23 fixed to the chassis 3 for distributing the paving material in front of paving screed 17 transversely to paving direction F. The spreading auger 23 and the material outlet 21 are concealed in FIG. 1 but shown in FIG. 2. A control station 25 is provided on the chassis 3 of the road finisher 1, which provides space for an operator and includes operating units 27 for making inputs to control the road finisher 1.

Figure 2:
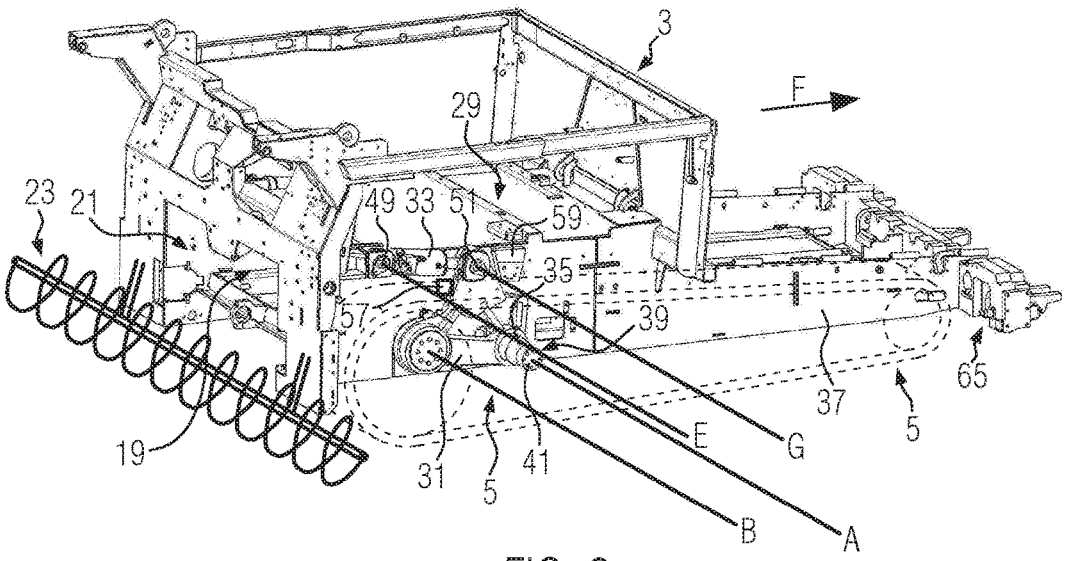
FIG. 2 shows a schematic perspective view of the chassis and the undercarriage of the road finisher according to the embodiment.

FIG. 2 shows a schematic side view of the undercarriage 5 and the chassis 3 of the road finisher 1, whereby for reasons of clarity various superstructures, components and claddings provided on the chassis 3 are not shown. A lifting device 29 for lifting the chassis 3 relative to the undercarriage 5 in the rear region of the road finisher 1 is provided in a rear region of the chassis 3 with respect to the paving direction F. The lifting device 29 comprises a rocker 31 on each of the two lateral sides of the road finisher 1 as well as a length-variable adjustment element 33. In the following, the design and function of the lifting device 29 are described for only one side of the road finisher 1. The opposite side can be of the same design.

The rocker 31 is rotatably mounted around an undercarriage rotation axis A at an undercarriage side bearing surface 35. As shown in FIG. 2, a track carrier 37 of the undercarriage 5 comprises a cylindrical recess 39, the inner wall of which forms the undercarriage side bearing surface 35. In the recess 39 a cylindrical extension 41 of the rocker 31 extending along the undercarriage rotation axis A is rotatably accommodated. Alternatively, it would also be conceivable that a corresponding recess would be provided in the rocker 31 and a cylindrical extension of the track carrier 37 would be rotatably accommodated in it about the undercarriage rotation axis A. In this case, the undercarriage side bearing surface 35 would be formed by the circumferential surface of the extension.

Figure 3:
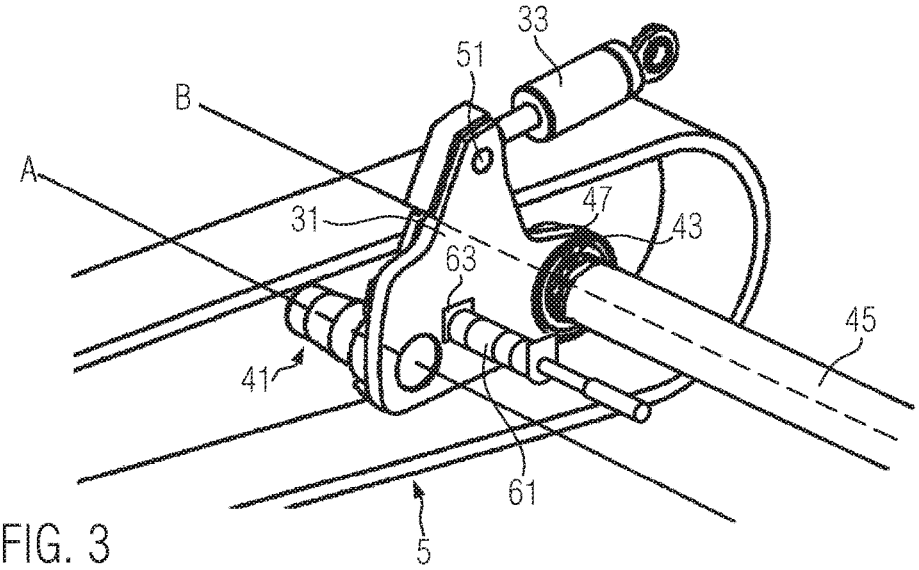
FIG. 3 shows a schematic perspective view of the rocker of a lifting device of the road finisher according to the embodiment.

In addition, the rocker 31 is mounted on a chassis-side bearing surface 43 so that it can rotate about a chassis rotation axis of B. As can be seen from the schematic view of the inner surface of the rocker 31, which is not visible in FIG. 2, as shown in FIG. 3, a cylindrical element 45, which is fixed to the chassis 3, is mounted in a corresponding recess 47 of the rocker 31 so that it can rotate about the chassis rotation axis B. The chassis-side bearing surface 43 is provided by an outer circumference of the cylindrical element 45. Alternatively, it would also be conceivable that an extension of the rocker 31 could be mounted in a corresponding recess of a chassis-fixed element so that it could rotate about the chassis rotation axis B. In this case, an inner circumferential surface of the recess would provide the chassis-side bearing surface 43.

The undercarriage rotation axis A and the chassis rotation axis B are parallel to each other and run in a transverse direction perpendicular to the paving direction of travel F.

As shown in FIG. 2, the first end of the length-variable adjustment element 33 is connected to a chassis-side link point 49, so that it can be rotated about a rotation axis E. A second end of the length-variable adjustment element 33 is connected to a rocker-side link point 51 so that it can be rotated about a rotation axis G. The length-variable adjustment element 33 thus connects the chassis-side link point 49 with the rocker-side link point 51. The rotation axis E and the rotation axis G are parallel to each other as well as to the chassis rotation axis A and the undercarriage rotation axis B and run in a transverse direction perpendicular to the paving direction F.

In the illustrated embodiment, the length-variable adjustment element 33 is a hydraulic cylinder. However, it would also be conceivable to provide another length-variable adjustment element 33, such as a spindle drive. The length-variable adjustment element 33 can be actuated by an actuator 53 to change its length. The actuator 53 may be controlled to change the length of the length-variable adjustment element 33 using control element 55, which in the embodiment shown is an operating element in control stand 25 of road finisher 1. This can be done in particular on the basis of user input by a road finisher operator.

By changing the length of the length-variable adjustment element 33 using the actuator 53, a distance between the chassis-side link point 49 and the rocker-side link point 51 is changed. This changes the position of rocker 31 in relation to undercarriage 5 and chassis 3 and thus selectively lifts or lowers chassis 3 in relation to undercarriage 5.

The length-variable adjustment element 33 extends at least essentially along a horizontal direction. In the illustrated embodiment, the chassis-side link point 49 is located behind the chassis rotation axis B and the chassis rotation axis A with respect to the paving direction F. However, it would also be conceivable that the chassis-side link point 49 would be located in front of the chassis rotation axis B and/or the chassis rotation axis A with regard to paving direction F.

Figure 4A:
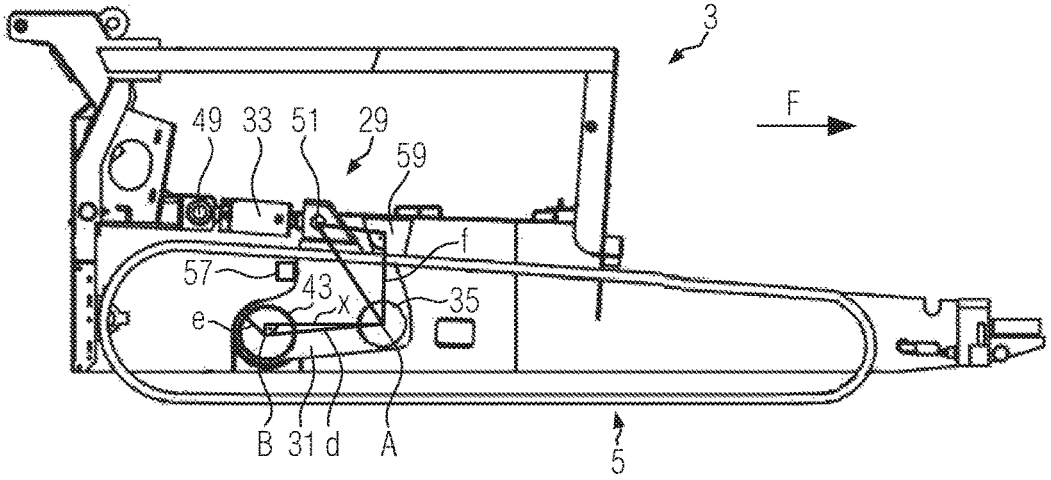
FIG. 4A shows a schematic side view of the undercarriage and chassis of the road finisher according to the embodiment in a maximum lowered position of the chassis.

FIG. 4A shows the chassis 3 in a maximum lowered position compared to the undercarriage 5. In the illustrated embodiment, this corresponds to a minimum length of the length-variable adjustment element 33. In the maximum lowered position of chassis 3 the chassis 3 is secured against further lowering by the engagement of the rocker 31 with a lower abutment 57 provided at chassis 3. If, from the position shown in FIG. 4A, the length of the length-variable adjustment element 33 is increased by the actuator 53, the distance between the chassis-side link point 49 and the rocker-side link point 51 increases. In the view shown in FIG. 4A, the rocker 31 is rotated clockwise about the undercarriage rotation axis A, which runs into the center of the drawing plane through the extension 41 of the rocker 31. This lifts the chassis 3 due to the bearing of the rocker 31 on the chassis-side bearing surface 43 which can be rotated around the chassis rotation axis B.

Figure 4B:
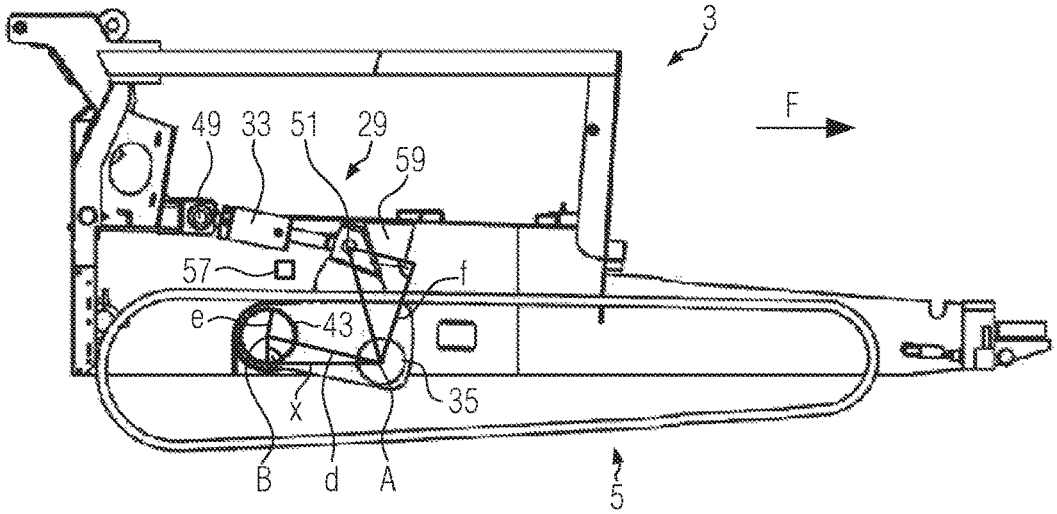
FIG. 4B shows a schematic side view of the undercarriage and chassis of the road finisher according to the embodiment in a maximum lifted position of the chassis.

If the length of the length-variable adjustment element 33 is extended further, the state shown in FIG. 4B is finally achieved. FIG. 4B shows a maximum lifted state of the chassis 3 in relation to the undercarriage 5. In this state the rocker 31 comes into engagement with an upper abutment 59 provided at the chassis 3, which prevents a further extension of the length of the length-variable adjustment element 33 and thus a further pivoting of the rocker 31 around the undercarriage rotation axis A.

By again reducing the length of the length-variable adjustment element 33 the chassis 3 can be lowered again from the position shown in FIG. 4B. Preferably the height of chassis 3 can be continuously adjusted between the minimum lifted state and the maximum lifted state by suitable adjustment of the length-variable adjustment element 33. However, it would also be conceivable to provide several discrete adjustment options.

As shown in FIG. 3, a locking element 61 designed as a locking bolt is provided in the illustrated embodiment for mechanically locking the rocker 31 in a defined relative position with respect to the chassis 3. The locking element 61 is provided at the chassis 3 and can be extended laterally in a horizontal plane perpendicular to the paving direction F by a locking element actuator 62 in order to engage a locking structure 63 of the rocker 31 in an extended position. In illustrated the embodiment, the locking structure 63 of the rocker 31 is designed as a recess. By locking engagement of the locking element 61 with the locking structure 63 of the rocker 31, the rocker 31 is fixed against changing its relative position in relation to the chassis 3 and the undercarriage 5. In this way, the chassis 3 can be mechanically secured at a defined height, for example at a transport position for transporting the road finisher 1 between construction sites.

As shown amongst other things in FIGS. 4A and 4B, a distance d between the chassis rotation axis B and the undercarriage rotation axis A is greater than a distance e between the chassis rotation axis B and the chassis-side bearing surface 43. The undercarriage rotation axis A is therefore outside the bearing of the rocker 31 at the chassis 3. This results in an improved power transmission when lifting the chassis 3. In addition, as can be seen, the lifting device 29 can be designed to be compact.

FIGS. 4A and 4B schematically illustrate the absolute value f of the part of the connection vector between the rocker-side linkage point 51 and the undercarriage rotation axis A which is perpendicular to the longitudinal extension direction of the length-variable adjustment element 33. In addition, the absolute value x of the part of the connection vector between the undercarriage rotation axis A and the chassis rotation axis B extending in a horizontal direction is shown schematically. Preferably, the ratio of these amounts, f/x, is greater than 0.5, than 0.7, than 1, than 1.3, than 1.5 or than 2. Thus, due to a leverage effect, particularly good power transmission is achieved when lifting or holding the chassis 3 by the length-variable adjustment element 33.

Figure 5:
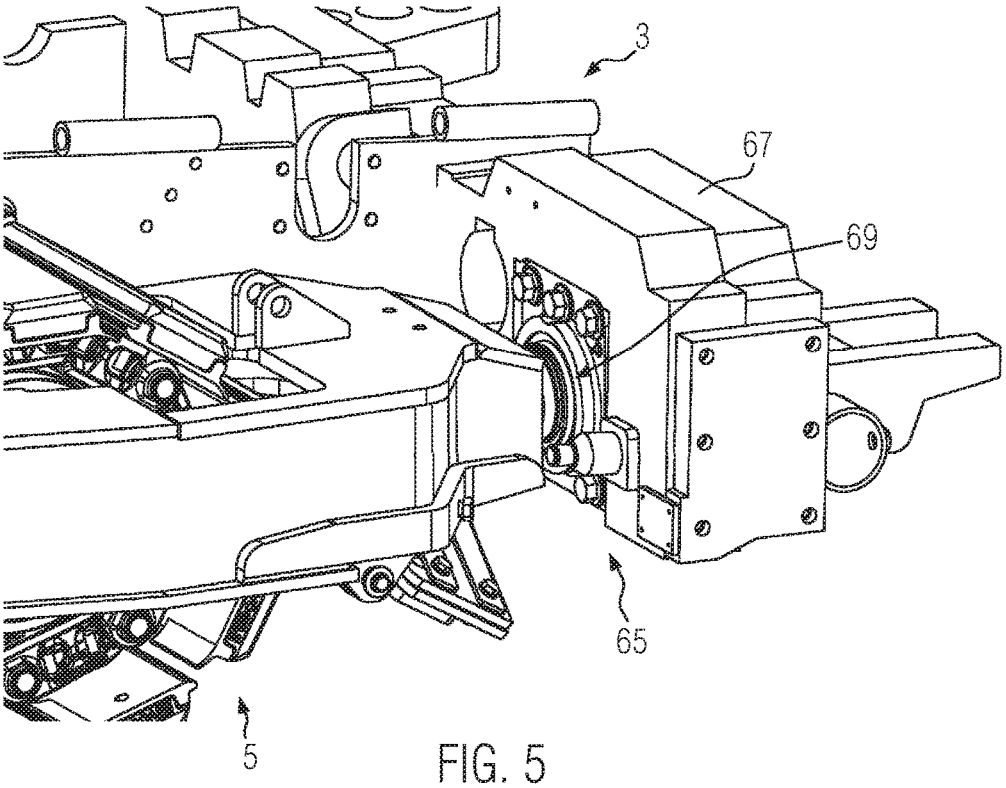
FIG. 5 shows a schematic perspective view of a right-hand connecting area between the undercarriage and the chassis, located at the front of the road finisher in the direction of travel in accordance with the embodiment.

In the illustrated embodiment, chassis 3 is mounted on undercarriage 5 in a front region of road finisher 1 with respect to paving direction F such that it can be pivoted and longitudinally displaced with respect to paving direction F. In this way, chassis 3 can be lifted or lowered in the rear region of the road finisher 1 relative to undercarriage 5 without creating tension in the front region of the road finisher 1. It is possible to lift chassis 3 asymmetrically in such a way that chassis 3 is lifted further in the rear region of the road finisher 1 than in the front region of the road finisher 1. FIG. 5 shows in a sectional schematic side view an attachment region 65 between the undercarriage 5 and the chassis 3 located on the right side of the road finisher 1. On the left side of the road finisher 1 there could be an analogous attachment region 65. The undercarriage 5 can be pivoted and is mounted on a bearing block 67 of chassis 3 so that it can be displaced longitudinally in relation to paving direction F. In particular, undercarriage 5 can be mounted at bearing block 67 using a pivoting bearing 69 with integrated sliding bearing.

Figure 6A:
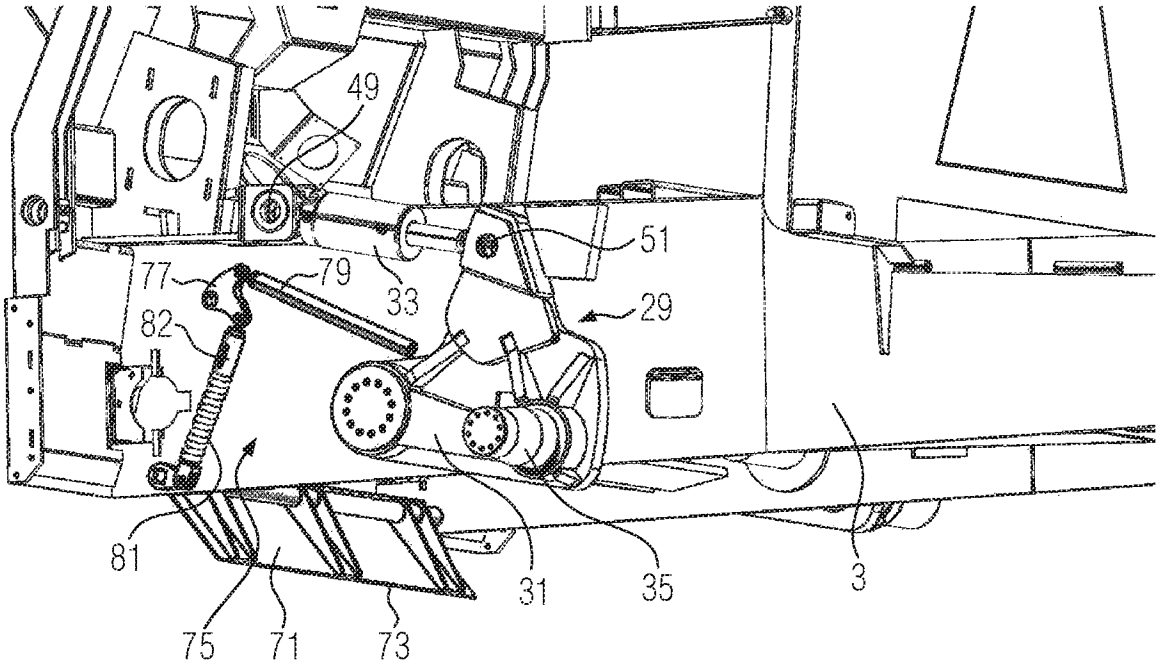
FIG. 6A shows a schematic perspective view of a chassis according to an embodiment with a folded-out material deflector and a coupling mechanism.

The view in FIG. 6A shows a chassis 3 of a road finisher 1 according to an embodiment with a material deflector 71. The latter may be provided on the chassis 3 in a movable, for example pivotable as shown in the embodiment, way. The material deflector 71 has a lower edge 73. A coupling mechanism 75 is provided for moving the material deflector 71, i.e., in the present embodiment for pivoting it. As in the present embodiment, this can be a mechanical coupling mechanism, in particular a purely mechanical coupling mechanism. In the present embodiment, the coupling mechanism comprises a deflection lever 77, which is rotatably mounted on the chassis 3. The connection lever 77 may be connected to a rod 79, which in turn can be connected to the lifting device 29, in the present embodiment to the rocker 31. The rod 79 may be adapted to transmit a movement of the lifting device 29, in particular a rotation of the rocker 31, to the deflection lever 77. The deflection lever 77 may be caused to rotate.

The rod 79 may have a thread through which the length of the rod 79 can be adjusted. This may allow adjustment of the coupling mechanism 75, e.g., to compensate for play and/or tolerances. A specific adjustment of the pivoting range of the material deflector 71 may also be enabled by such a thread.

The deflection lever 77 may additionally be connected to an elastic element 81. The elastic element 81, in turn, can be connected to the material deflector 71 in such a way that a movement or deflection, for example an expansion or compression, of the elastic element 81 causes the material deflector 71 to move, in particular to pivot. The aforementioned components may interact in such a way that a movement of the lifting device 29 displaces the rod 79, whereby the deflection lever 77 can be rotated. The rotation of the deflection lever 77 can in turn move the elastic element 81, whereby the material deflector 71 can be moved, in particular pivoted.

The elastic element 81 can be provided on a bar 82. This strut can be used to prevent the elastic element 81 from bending. The bar 82 may be telescopic to allow deflection of the elastic element 81. Similar to the rod 79, the bar 82 can have a thread through which the length of the bar 82 can be adjusted. This may provide an additional adjustment option for the coupling mechanism 75, e.g., to compensate for play and/or tolerances. A specific adjustment of the pivoting range of the material deflector 71 may also be enabled by such a thread. The coupling mechanism 75 may also have a bar 82 without an elastic element 81 being provided on it. In this case, any designs that are not telescopic are also conceivable. However, a thread may be advantageous in variants without elastic element 81 as well.

Figure 6B:
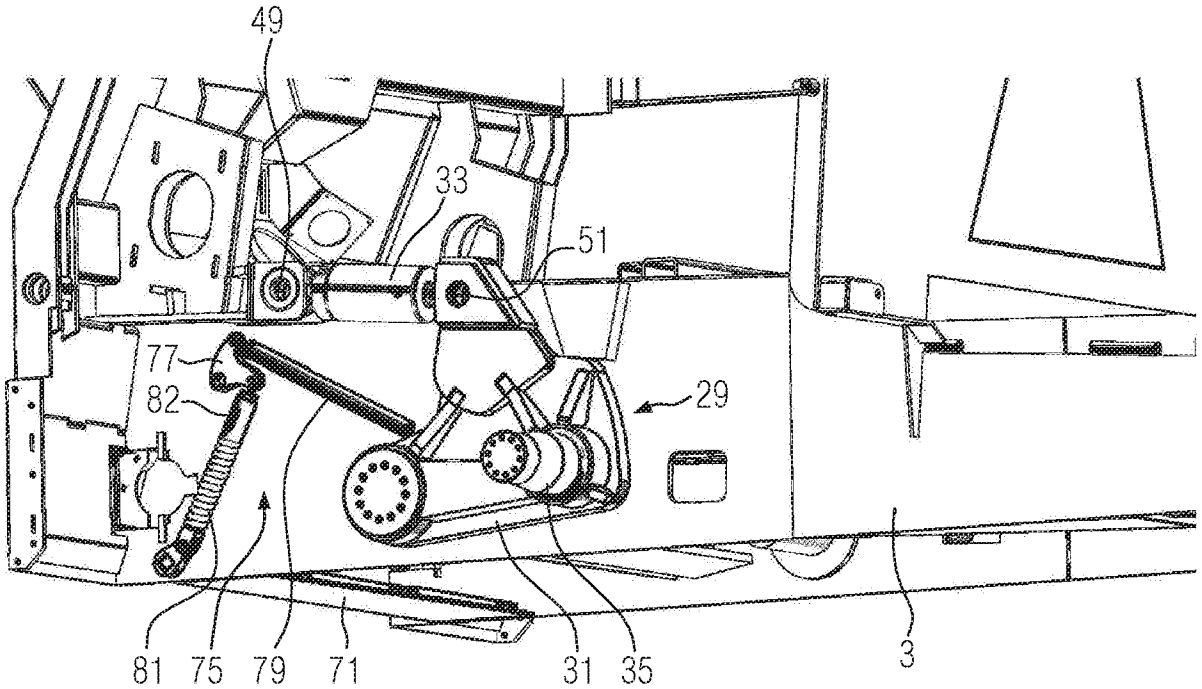

FIG. 6A shows the lifting device 29 in a position, in which the chassis 3 is lifted in relation to the undercarriage 5. By the position of the rocker 31, the material deflector 71 was moved into a folded out position by the interaction of the rod 79, the deflection lever 77 and the elastic element 81. FIG. 6B shows the lifting device 29 in a position, in which the chassis 3 is disposed in a fully lowered position relative to the undercarriage 5. In this case, as can also be seen in FIG. 6B, the material deflector 71 is arranged in a folded position.

Figure 7A:
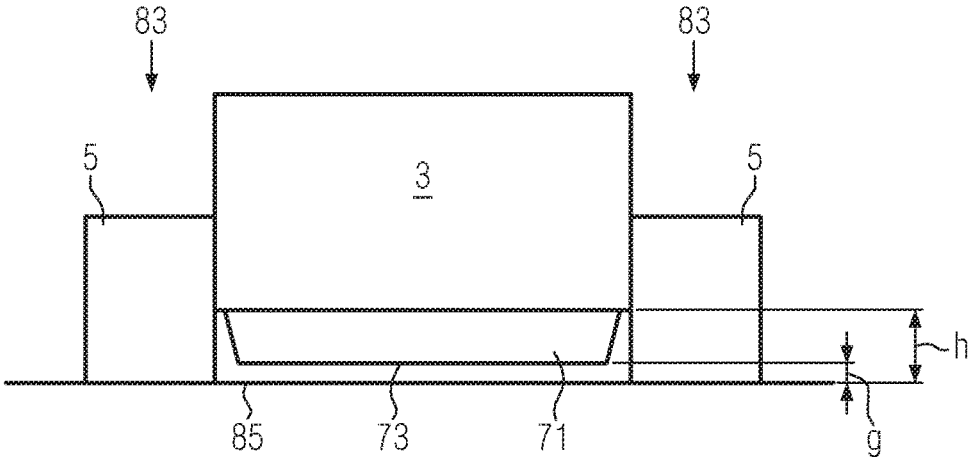
FIG. 7A shows a schematic rear view of a chassis with two undercarriages according to the embodiment from FIGS. 6A and 6B in a lifted position.

In the schematic view shown in FIG. 7A, the chassis 3 and the undercarriages 5 can be seen from behind. Traction tracks 83 are defined by undercarriages 5. The material deflector 71 is arranged between the traction tracks 83. In FIG. 7A, the chassis is raised relative to the undercarriages 5 and the material deflector 71 is folded out. The lower edge 73 is arranged at a distance g from a ground 85. The distance h is defined between the chassis 3 and the ground 85.

Figure 7B:
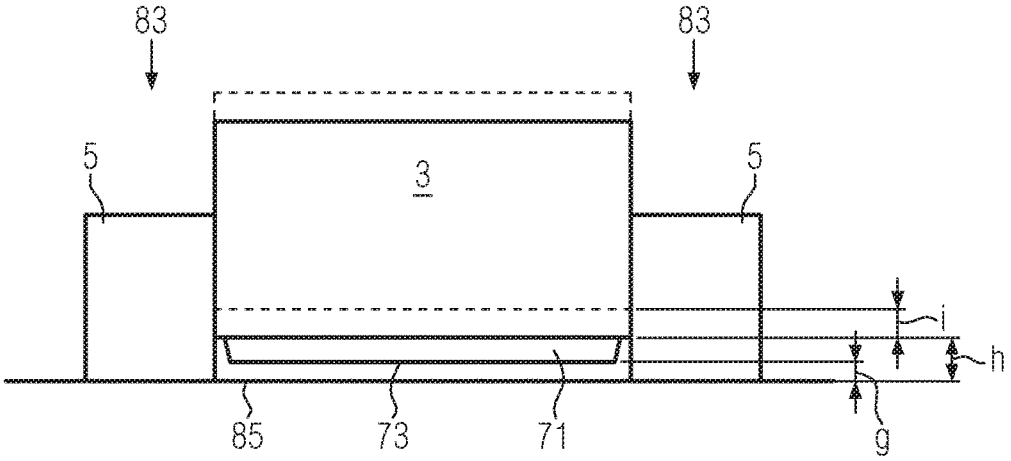
FIG. 7B shows the view from FIG. 7A in a lowered position of the chassis.

In FIG. 7B the chassis 3 is lowered relative to the undercarriage 5 by a lifting distance i relative to the position shown in FIG. 7A. The distance g between the lower edge 73 and the ground 85 is the same as in FIG. 7A.

Figure 8:
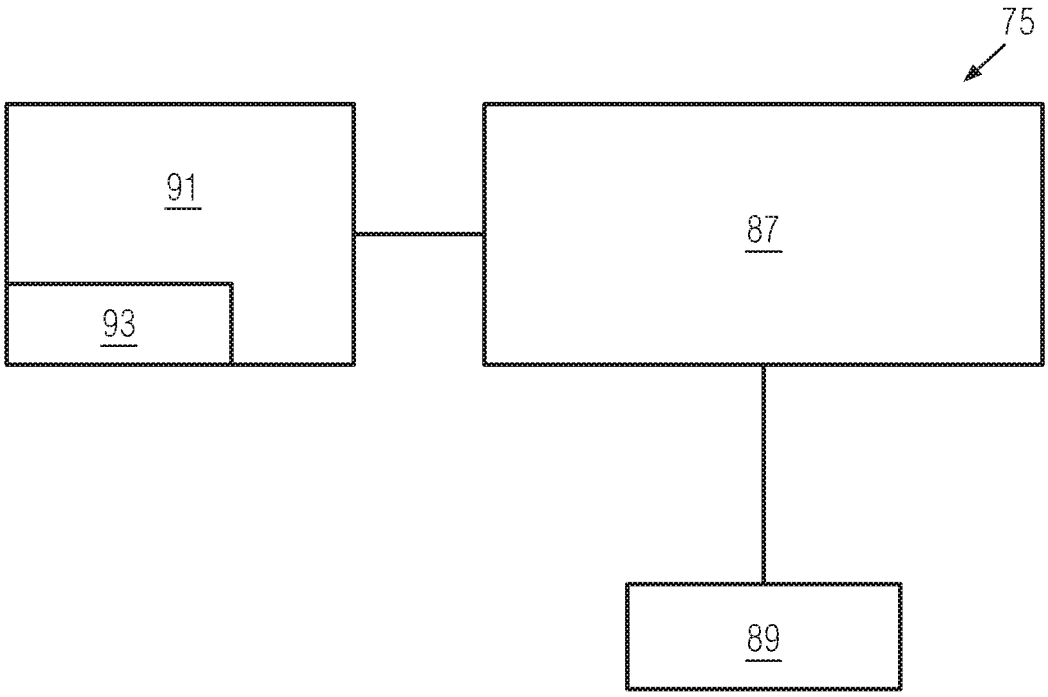
FIG. 8 shows a schematic representation of a coupling mechanism comprising an open loop or closed loop control unit according to another embodiment.

FIG. 8 is a schematic representation of the coupling mechanism 75 according to another embodiment. In this embodiment, the coupling mechanism 75 comprises a closed loop control unit 87. Alternatively, an open loop control unit may also be provided. Furthermore, the coupling mechanism 75 may have a sensor unit 89 according to this embodiment. This sensor unit may be configured to measure or determine the distance g between the lower edge 73 and the ground 85 and/or the lifting distance i and/or the distance h between the chassis 3 and the ground 85. The sensor unit 89 may be connected to the control unit 87 to transmit measured or detected values to the control unit 87.

The coupling mechanism 75 according to the embodiment shown in FIG. 8 may also have an actuator unit 91. This actuator unit can be connected to control unit 87 to receive control signals. In cases where an open loop control unit is provided, the actuator unit 91 may also be connected to it to receive control signals. The actuator unit 91 may have an actuator 93. The latter may be configured to move the material deflector 71, in particular to pivot it. The actuator 93 may be any suitable actuator known to a person skilled in the art. In particular, electric, hydraulic, electrohydraulic or pneumatic actuators are conceivable, for example an electric or servo motor, or a hydraulic cylinder. Accordingly, the control unit 87 may be an electric, hydraulic, electrohydraulic or pneumatic control unit.

Various possibilities are conceivable for closed loop or open loop controlling of the movement of the material deflector 71. For example, it is conceivable that the sensor unit 89 could detect the distance g between the lower edge 73 of the material deflector 71 and the ground 85 and transmit this to the control unit 87. The control unit 87 may then be configured to transmit control signals to the actuator unit 91 based on the received distance, said signals causing the actuator unit 91 to control the actuator 93 in such a way that the distance g between the lower edge 73 and the ground 85 remains constant.

Alternatively, the sensor unit 89 can detect the lifting path i and transmit it to the control unit 87. Based on the lifting distance i, the latter may determine a target position of the material deflector 71, which is assigned to the detected lifting distance i. An assignment of a lifting path i to a position of the material deflector 71 may be made using mathematical formulas or tables. It is conceivable that the control unit 87 transmits the target position to the actuator unit 91 and that this actuator unit 91 independently controls the actuator 93 in such a way that the material deflector 71 assumes the received target position. However, it is also conceivable that the control unit 87 itself comprises a controller and only transmits control signals to the actuator unit 91.

Figure 9A:
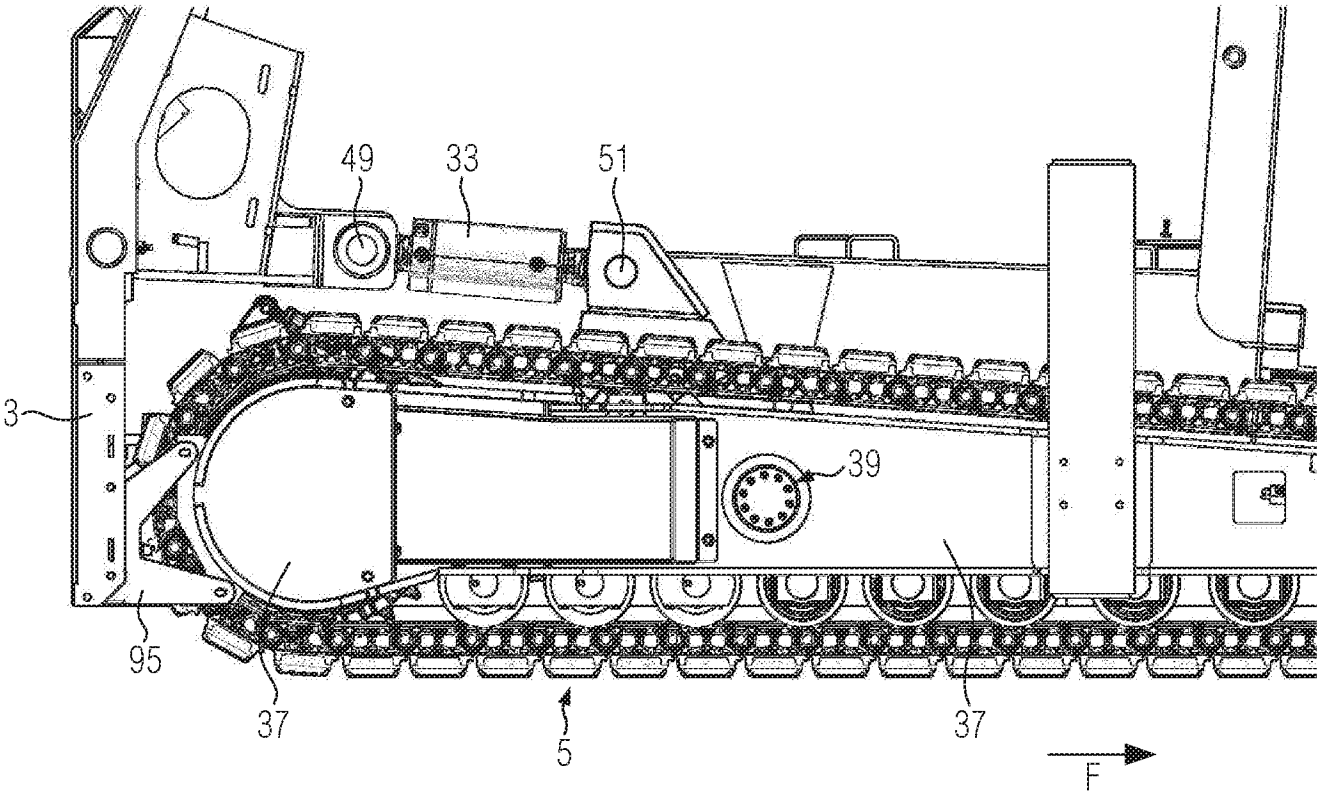
FIG. 9A shows a schematic side view of a lowered chassis with undercarriage according to an embodiment with chassis protector.

FIG. 9A shows a side view of an undercarriage 5 of a road finisher 1 according to another embodiment. In this embodiment, an undercarriage protector 95 is provided. The latter may be attached to the track carrier 37, for example, as shown in the embodiment. In the configuration shown in FIG. 9A, the chassis 3 is completely lowered relative to the undercarriage 5. In this configuration, the undercarriage protector 95 is covered to the rear by the chassis 3 when viewed in the driving direction. In this configuration, the chassis 3 prevents the paving material from entering the area of the undercarriage 5.

Figure 9B:
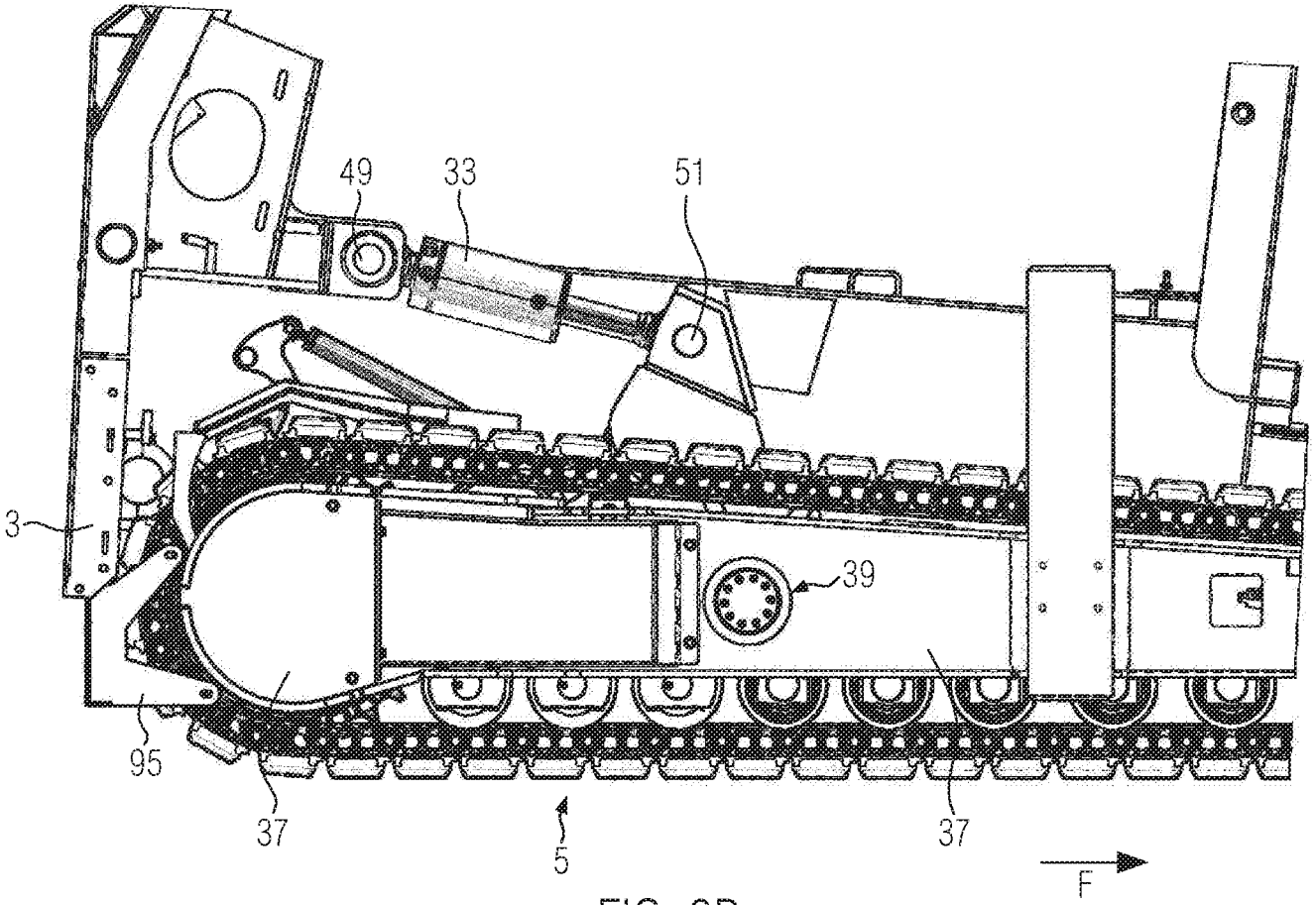
FIG. 9B shows the view from FIG. 9A with the chassis lifted relative to the undercarriage.

In FIG. 9B, chassis 3 is lifted relative to the undercarriage 5. As in this embodiment, this may cause the undercarriage protector 95 to be exposed. In this configuration, the undercarriage protector 95 may prevent the paving material from entering the area of the undercarriage 5. It can also be seen that, without undercarriage protector 95, there would be considerably more space between the lower edge of chassis 3 and the ground, which would allow the paving material to enter the area of the undercarriage.

What is claimed is:

1. A road finisher comprising:

an undercarriage with two traction tracks;

a chassis;

a hopper, which is mounted on the chassis at a front of the road finisher with respect to a paving direction, for receiving paving material;

a paving screed provided at a rear of the road finisher with respect to the paving direction for compacting paving material, the paving screed being attached to the chassis by pulling arms;

a lifting device which is configured to lift the chassis relative to the undercarriage at least in a rear area of the road finisher; and a material deflector arranged between the two traction tracks and that is movable relative to the chassis.

2. The road finisher according to claim 1 further comprising an actuator unit configured to move the material deflector relative to the chassis.

3. The road finisher according to claim 2 wherein the actuator unit is configured to pivot the material deflector relative to the chassis.

4. The road finisher according to claim 2 further comprising a sensor unit configured to detect a distance of the chassis from a ground and/or a lifting path between the chassis and the undercarriage and/or a distance of a lower edge of the material deflector from the ground, wherein the actuator unit is configured to move the material deflector based on signals generated by the sensor unit.

5. The road finisher according to claim 2 wherein the actuator unit comprises an electric, hydraulic, electrohydraulic or pneumatic actuator.

6. The road finisher according to claim 2 wherein the actuator unit comprises an elastic element.

7. The road finisher according to claim 6 wherein the elastic element is configured to be deflected when the movement of the material deflector is blocked.

8. The road finisher according to claim 1 further comprising a sensor unit configured to detect a distance of the chassis from a ground and/or a lifting path between the chassis and the undercarriage and/or a distance of a lower edge of the material deflector from the ground.

9. The road finisher according to claim 8 wherein the sensor unit comprises a laser sensor, a radar sensor or an ultrasonic sensor.

10. The road finisher according to claim 1 wherein the lifting device comprises a rocker which is mounted rotatably about an undercarriage rotational axis on an undercarriage-side bearing surface and rotatably about a chassis rotational axis on a chassis-side bearing surface.

11. The road finisher according to claim 10 wherein the lifting device further comprises a length-adjustable adjustment element which connects a chassis-side link point to a rocker-side link point and is configured to change a distance between the chassis-side link point and the rocker-side link point by changing its length and thus selectively lift or lower the chassis relative to the undercarriage.

12. The road finisher according to claim 1 further comprising a coupling mechanism configured to move the material deflector relative to the chassis when the lifting device lifts the chassis relative to the undercarriage.

13. The road finisher according to claim 12 wherein the coupling mechanism comprises a deflection lever rotatably mounted on the chassis.

14. The road finisher according to claim 12 further comprising an actuator unit configured to move the material deflector relative to the chassis, and a sensor unit configured to detect a distance of the chassis from a ground and/or a lifting path between the chassis and the undercarriage and/or a distance of a lower edge of the material deflector from the ground, wherein the coupling mechanism comprises an open loop or closed loop control unit connected to the sensor unit and the actuator unit, and wherein the control unit is configured to actuate the actuator unit in response to signals received from the sensor unit.

15. The road finisher according to claim 12 wherein the coupling mechanism comprises an elastic element.

16. The road finisher according to claim 15 wherein the elastic element is configured to be deflected when the movement of the material deflector is blocked.

17. The road finisher according to claim 1 further comprising an undercarriage protector which is arranged in the paving direction behind one of the traction tracks.

18. The road finisher according to claim 17 wherein the undercarriage protector is concealed towards a rear side of the road finisher by the chassis in a position of the chassis which is lowered to a maximum relative to the undercarriage and can be exposed by lifting the chassis.

* * * * *